US005353476A

United States Patent [19]

Domenig

[11] Patent Number: 5,353,476

[45] Date of Patent: Oct. 11, 1994

[54] HINGE CUP POSITIONING DEVICE

[75] Inventor: Georg Domenig, Kernersville, N.C.

[73] Assignee: Grass America Inc., Kernersville, N.C.

[21] Appl. No.: 35,416

[22] Filed: Mar. 23, 1993

[51] Int. Cl.[5] ..... E05D 7/04

[52] U.S. Cl. ..... 16/247; 16/383

[58] Field of Search ..... 16/247, 382, 235, 236, 16/237, 238, 239, 240, 242, 383, 370

[56] References Cited

U.S. PATENT DOCUMENTS

| | | | |
|---|---|---|---|
| 2,154,716 | 4/1939 | Anderson | 16/247 |
| 3,968,540 | 7/1976 | Lautenschlager et al. | 16/370 |
| 4,290,167 | 9/1981 | Lautenschlager | 16/247 |
| 4,411,045 | 10/1983 | Röck et al. | 16/247 |
| 4,434,523 | 3/1984 | Grass | 16/242 |
| 4,590,641 | 5/1986 | Lautenschlager et al. | 16/238 |
| 4,862,556 | 9/1989 | Grass | 16/382 |
| 4,982,476 | 1/1991 | Salice | 16/237 |
| 5,175,908 | 1/1993 | Domenig | 16/237 |
| 5,195,214 | 3/1993 | Lautenschlager et al. | 16/382 |

FOREIGN PATENT DOCUMENTS

| | | | |
|---|---|---|---|
| 155092 | 1/1953 | Australia | 16/247 |
| 3126614 | 6/1982 | Fed. Rep. of Germany | 16/384 |
| 205609 | 1/1984 | Fed. Rep. of Germany | 16/247 |

*Primary Examiner*—Lowell A. Larson
*Assistant Examiner*—Donald M. Gurley

[57] ABSTRACT

An improvement in a configured hinge having a hinge cup for mounting on a surface provided with a hinge cup bore hole comprising a spacer having a pre-selected thickness and a periphery substantially conforming to the configuration of the hinge cup for mounting beneath the hinge cup flange near the bore hole to compensate for the less than standard depth of the bore hole.

3 Claims, 1 Drawing Sheet

HINGE CUP POSITIONING DEVICE

BACKGROUND OF THE INVENTION

1. Field of the Invention

The present invention relates to cabinet hinges and more particularly to cabinet hinges that are adaptable to varying circumstances and conditions.

2. Description of Prior Art

Hinges having a hinge cup that is mounted on a surface provided with a hinge cup bore hole are well known, and representative of such hinges are those disclosed in U.S. Pat. Nos. 4,312,098 and 4,509,229. Hinge cup bore holes are drilled by standard machinery to a depth of 12 millimeters. This demension is standard in the industry for hinges of this nature.

Occasionally, door thickness vary or taper to the extent that the 12 millimeter depth exceeds the thickness of the door member and thus interferes with the application of a standard hinge produced to cooperate with the 12 millimeter bore hole depth. The problem can be corrected, rather expensively, by providing bore holes manually rather than by the conventional machinery for accomplishing this task. Unfortunately such activity is time consuming, costly, and to be avoided if at all possible.

The present invention is directed to eliminating the problem.

OBJECTIVES AND SUMMARY OF THE INVENTION

The purpose of the invention, which will be described subsequently in greater detail, is to provide a spacer having a preselected thickness and a periphery substantially coinciding with the configuration of the hinge cup for mounting beneath the hinge cup flange and adjacent the bore hole to compensate for the less than standard depth of the bore hole when it is impossible to drill the bore hole to the standard depth.

Another objective of the invention is to adapt the spacer to provide means for horizontally adjusting the position on the mounted surface when a bore hole of standard depth in that surface is impossible.

A further objective of the present invention is to provide apertures in the spacer that will coincide with apertures of the configured hinge to cooperatively receive screws or pins that secure the hinged spacer to the mounted surface.

Yet another object of the present invention is to provide a spacer with secured dowels aligned with the apertures and positioned to receive the screws and pins.

Yet still another object of the present invention is to enable horizontal adjustment of the mounted surface by utilizing slotted apertures.

The invention is a spacer to be utilized in conjunction with a configured hinge having a hinge cup which is to be mounted on a surface provided with a hinge cup bore hole, the spacer having a preselected thickness and a periphery substantially coinciding with the configuration of the hinge cup for mounting beneath the hinge cup flange and adjacent the bore hole to compensate for the less than standard depth of the bore hole. The spacer includes additional features which facilitate horizontal adjustment on the mounted surface including slotted apertures and secured dowels aligned with the apertures and positioned to receive screws and pins.

Thus, there has been outlined the more important objectives of the invention and a summary thereof in order that the detailed description that follows may be better understood and in order that the present contribution to the art may be better appreciated. There are additional features of the invention that will be described hereinafter which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways.

For a better understanding of the invention, its operating advantages, and the specific results obtained by its uses, reference should be made to the following detailed specification taken in conjunction with the accompanying drawings in which like characters of reference designate like parts throughout the several views.

DETAILED DESCRIPTION OF THE PREFERRED EMBODIMENT

Figure 1:
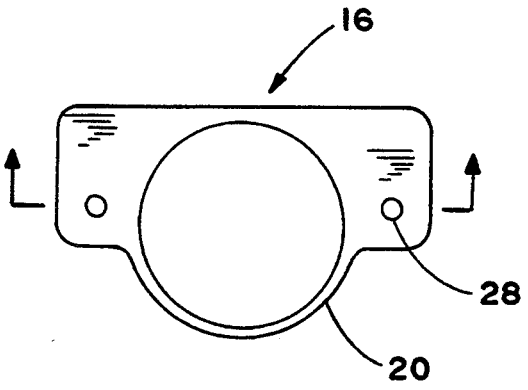
FIG. 1 is a plan view of the spacer comprising the present invention showing a periphery that coincides with the configuration of the hinge with which it is associated.
Figure 2:
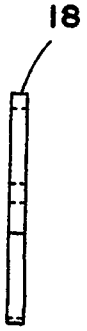
FIG. 2 is a side elevational view of the spacer shown in FIG. 1.
Figure 3:
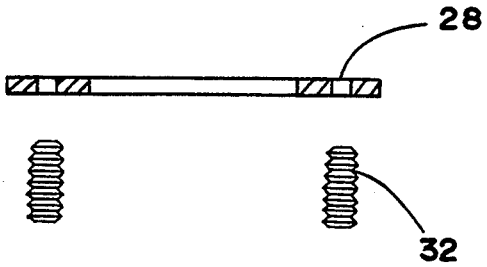
FIG. 3 is a front elevational and exploded view of the spacer shown in FIGS. 1 and 2 associated with dowels which may be formed with the spacer or used separate with respect thereto.
Figure 4:
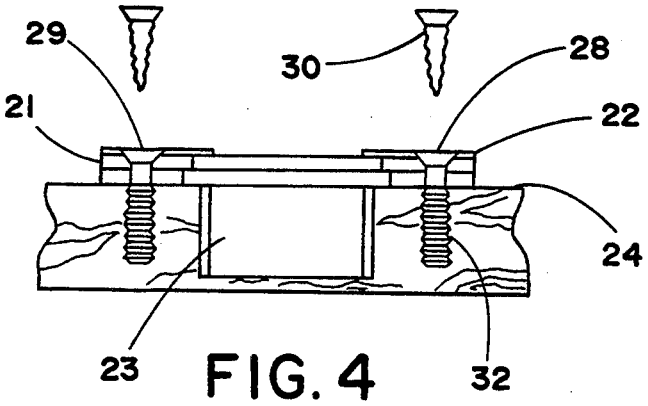
FIG. 4 is a front elevational and sectional view of the spacer comprising the present invention used in connection with a hinge cup and dowels and secured to a mounted surface.
Figure 5:
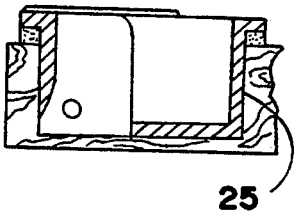
FIG. 5 is a side elevational, fragmentary and sectional view of the assembly shown in FIG. 4.
Figure 6:
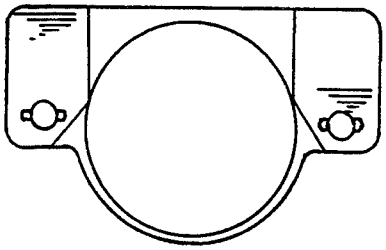
FIG. 6 is a plan view of the spacer comprising the present invention showing slotted apertures to receive screws or pins and enable horizontal adjustment on the mounted surface.

Referring now to the drawings and particularly to FIG. 1, a spacer shown generally as 16 has a specific thickness 18 and an outer periphery 20 that generally conforms to the periphery of a conventional hinge 21 having a hinge cup 23 for mounting on a surface provided with a hinge cup bore hole 25. Spacer 16 contains a plurality of apertures 28 that coincide with the apertures 29 in the hinge itself. Screws 30 affix hinge 21 and spacer 16 to door front 24.

A plurality of dowels 32 may be used to secure the spacer and hinge to door front 24 or to provide bores for screws to be subsequently inserted.

Apertures 28 of the spacer 16 can be slotted to coincide with slotted apertures on the cooperating hinge and thus enable horizontal adjustment of the door with respect to the supporting frame.

Spacer 16 may be provided in varying thicknesses depending on the need of a particular application. Because it is thin, of uniform thickness, and conforms to the peripheral configuration of the hinge itself, it is for the most part unnoticed and not therefore a detraction from the finished product.

It is to be understood that although a primary embodiment of the present inventive concept has been illustrated and described, various features of the disclosed invention are equally well suited to hinges of other configurations. Although various materials and connecting techniques are possible, the optimum materials and dimensions will depend on, with particularity, the field where the inventive concept is used as well as other factors. It is to be understood that the form of the invention herewith shown and described is to be taken as an illustrative embodiment only and that various changes in the shape, size and arrangement of parts may be based without departing from the spirit and purpose of the invention.

The claims are to be regarded as including such equivalent methods and products resulting therefrom that do not depart from the spirit and scope of the present invention. The application is neither intended to define the invention, which is measured by its claims, nor to limit its scope in any way.

What is claimed is:

1. In a configured hinge comprising a hinge cup having a flange with elongated apertures therein for mounting the hinge cup on a surface provided with a hinge cup bore hole of less than standard depth, the improvement comprising a substantially flat annular spacer having a selected uniform thickness and an inner periphery conforming to an outer configuration of the hinge cup for mounting beneath the hinge cup flange and adjacent the bore hole to compensate for the less than standard depth of the bore hole required because of the thickness of the surface, the spacer having elongated apertures coinciding with the flange apertures and an enclosed circular opening to cooperatively receive the hinge cup when the spacer is positioned beneath the hinge cup flange.

2. The improvement as claimed in claim 1 wherein the spacer has a plurality of apertures corresponding with the apertures of the configured hinge to cooperatively receive screws or pins to secure the hinge and spacer to the surface.

3. The improvement as claimed in claim 2 wherein the spacer has dowels aligned with the apertures and positioned to receive the screws or pins.

* * * * *